United States Patent [19]

Takahashi

[11] Patent Number: 4,470,592

[45] Date of Patent: Sep. 11, 1984

[54] APPARATUS FOR GUIDING A SHEET

[75] Inventor: Takehiro Takahashi, Mihara, Japan

[73] Assignee: Mitsubishi Jukogyo Kabushiki Kaisha, Tokyo, Japan

[21] Appl. No.: 442,641

[22] Filed: Nov. 18, 1982

[30] Foreign Application Priority Data

Nov. 19, 1981 [JP] Japan ..... 56-172185[U]

[51] Int. Cl.[3] ..... B65H 5/06

[52] U.S. Cl. ..... 271/273; 226/177; 226/189; 226/194

[58] Field of Search ..... 271/272, 273, 274, 125; 226/176, 177, 194, 189, 199

[56] References Cited

U.S. PATENT DOCUMENTS

| | | | |
|---|---|---|---|
| 1,381,589 | 6/1921 | Ogden | 271/125 |
| 3,454,271 | 7/1969 | Bishop | 271/274 |
| 4,158,429 | 6/1979 | Ohmori | 226/177 |

*Primary Examiner*—Richard A. Schacher

*Attorney, Agent, or Firm*—Bernard, Rothwell & Brown

[57] ABSTRACT

An apparatus is provided for guiding a corrugated cardboard sheet in a transfer portion and machining portion of a corrugated cardboard sheet box-making machine. Eccentric bearing boxes are provided for supporting feed rolls which define a path of travel for the corrugated cardboard sheet. The eccentric bearing boxes are rotatable to adjust the position of the rolls vertically depending on the thickness of the sheet then being run through the machine. The apparatus further includes sheet guide means for guiding the corrugated cardboard sheet to the feed rolls. The sheet guide means includes guide plates supported on brackets which in turn are supported on portions of the eccentric bearing boxes. Adjustment of the position of the eccentric bearing boxes for moving the feed rolls simultaneously effects corresponding adjustment of the position of the guide plates so that a constant difference in level between the guide plates and the upper periphery of the feed rolls is maintained.

7 Claims, 15 Drawing Figures

APPARATUS FOR GUIDING A SHEET

BACKGROUND OF THE INVENTION

1. Field of The Invention

This invention relates to apparatus for guiding a sheet in a corrugated cardboard sheet box-making machine, and more particularly, to apparatus for effectively and efficiently accommodating corrugated cardboard sheet of different thicknesses.

2. Description of The Prior Art

In the making of corrugated cardboard sheet boxes, machines are provided for successively performing various operations on the corrugated sheet cardboard. For example, machines are provided for feeding the sheet through a printing operation and then through a slitting and scoring operation. These machines include feed rolls for moving the sheet through the successive operations and sheet guiding and supporting means by which the sheet is guided as it is progressively moved through the box-making machine by the feed rolls.

In the normal operation of such machines, corrugated cardboard sheet of differing thicknesses may be fed in successive runs. In order to accommodate such board of differing thickness it is necessary to adjust correspondingly the gap between the feed rolls through which the board is fed.

In order to effect satisfactory operation of the machine it is desirable that the difference in height between the upper periphery of the lower feed roll and the upper surface of the corresponding guide plate be maintained at a constant value. However, in conventional machines when adjustment of the feed rolls is made the position of the guide plate is not usually adjusted because of the time involved in obtaining access for the adjustment of the guide plates and the time for effecting such adjustment. In conventional machines such adjustment requires a substantial amount of effort and a corresponding amount of time and hence adversely affects production. On the other hand, if the adjustment of the guide plates is not made in general correspondence with the adjustment of the feed roll, sheets of smaller thickness for example are not fed in a proper manner to the feed rolls and timing errors occur in the printing and ruling of the cardboard sheet, resulting in the production of products lacking the desired accuracy of finishing.

In accordance with this invention, apparatus is provided which in a simple manner effects the adjustment of the position of the guide plates simultaneously with the adjustment of the position of the feed roll so that a constant difference between the level of the upper periphery of the adjustable feed roll and the upper surface of the guide plate is maintained. Moreover, this adjustment is made by a single adjusting means which, upon movement thereof, effects simultaneously the adjustment of the position of the feed roll and the adjustment of the position of the guide plate by corresponding amounts. By this arrangement the difference in height between the guide plate and the upper periphery of the adjustable feed roll is maintained at a constant value and corrugated sheet of varying thickness is fed with satisfactory speed and timing through the apparatus, resulting in improved quality of the finished product.

Accordingly, it is an object of this invention to provide apparatus of this type wherein adjustment of the feed rolls and of the guide plate is effected simultaneously and in substantially the same amount by a single adjusting means so as to maintain a constant difference between the level of the upper periphery of the adjustable feed roll and the upper surface of the guide plate regardless of the thickness of the corrugated cardboard sheet being supplied to the machine.

It is another object of this invention to effect this adjustment in a simple, easy and efficient manner without the necessity of opening any portion of the apparatus to secure work space and both the quantity and quality of the manufactured products are increased In describing the invention in detail later in the specification a detailed illustration and description of a conventional corrugated cardboard sheet box-making machine is set forth so that the problems of the prior art and the advantages of the apparatus of this invention can be better appreciated.

SUMMARY OF THE INVENTION

In one form thereof, an apparatus is provided for guiding a corrugated cardboard sheet in a transfer portion and machining portion of a corrugated cardboard sheet box-making machine. Eccentric bearing boxes are provided for supporting feed rolls and receiving rolls which define a path of travel for the corrugated cardboard sheet. The eccentric bearing boxes are rotatable to adjust the position of the rolls vertically depending on the thickness of the sheet then being run through the machine. The apparatus further includes sheet guide means for guiding the corrugated cardboard sheet to the receiving rolls and feed rolls. The sheet guide means includes guide plates supported on brackets which in turn are supported on portions of the eccentric bearing boxes. The eccentric bearing boxes include gears accessible from the exterior of a supporting frame of the apparatus. An adjusting lever including a pinion which engages one of the aforementioned gears is provided for effecting vertical adjustment of the feed rolls by rotating the eccentric bearing boxes to accommodate corrugated cardboard sheet of varying thicknesses. Adjustment of the position of the eccentric bearing boxes for moving the feed rolls simultaneously effects corresponding adjustment of the position of the guide plates so that a constant difference in level between the guide plates and the upper periphery of the feed rolls is maintained.

DETAILED DESCRIPTION OF THE PREFERRED EMBODIMENTS

In order to provide a better understanding of the invention, before proceeding with the detailed description of the invention which is the subject of this application, a conventional prior art machine illustrated in FIGS. 1–7 will first be described.

Figure 1:
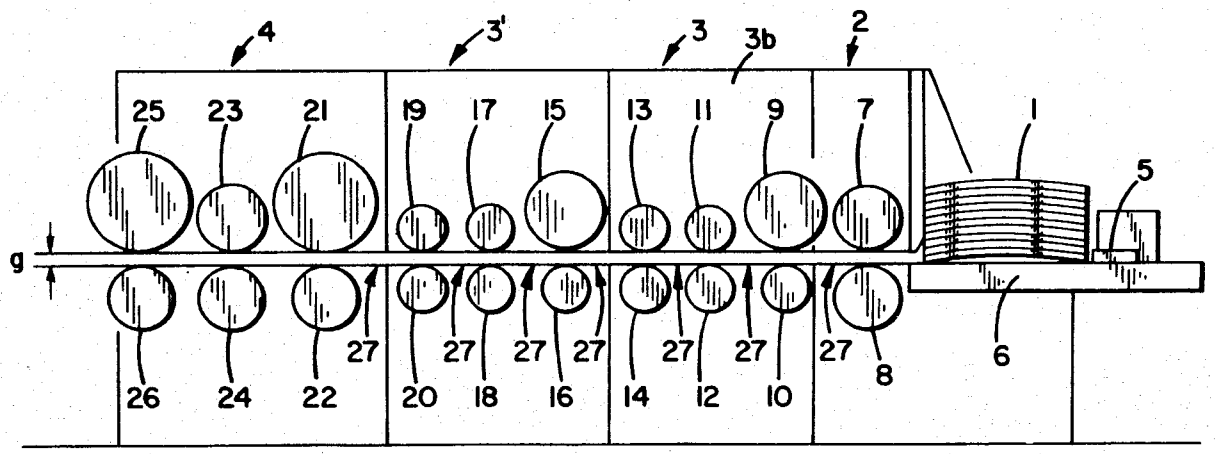
FIG. 1 PRIOR ART
FIG. 1 is a diagrammatic view illustrating a conventional prior art machine for making corrugated cardboard boxes.

Referring to FIG. 1, the conventional corrugated cardboard sheet box-making machine there illustrated includes provision for passing corrugated cardboard sheets 1 through a sheet feed portion 2, printing portions 3, 3' and a sheet discharge portion 4.

Figures 2, 3, 4, 5:
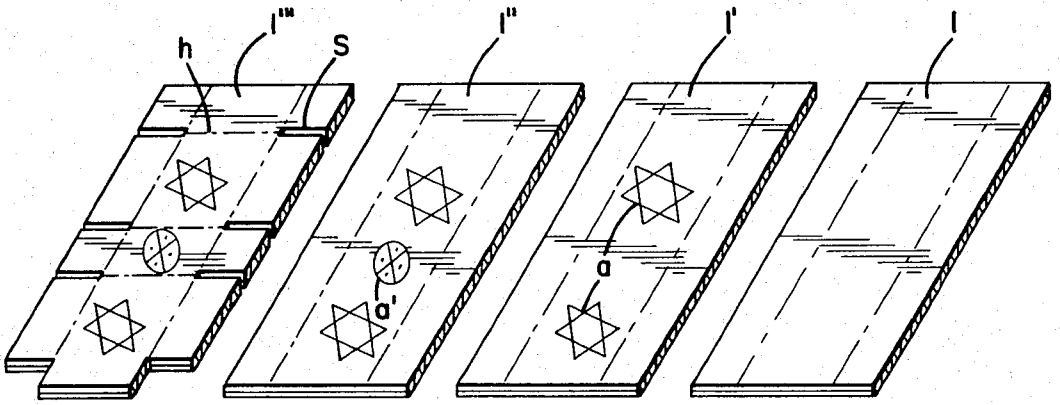
FIGS. 2 to 5 are a series of perspective views showing a corrugated cardboard sheet at various stages of the box-making operation.

In FIG. 1, corrugated cardboard sheets 1 that have been sent from the preceding step are stacked on a table 6 of the sheet feed portion 2 as depicted in FIG. 2 and the lowermost corrugated cardboard sheets are kicked one by one into a pair of feed rolls 7, 8 by a kicker 5. The corrugated cardboard sheet 1 fed toward the left in FIG. 1 by feed rolls 7, 8 and transferred between a printing cylinder 9 of the printing portion 3 and a receiving roll 10 along a sheet guide 27, where it is printed as represented by symbol a on the sheet identified by the numeral 1' in FIG. 3. Subsequently, the corrugated cardboard sheet 1' is transferred between a printing cylinder 15 of the printing portion 3' and a receiving roll 16 by two pairs of feed rolls 11, 12 and 13, 14 and is printed as represented by symbol a' on the sheet identified by the numeral 1'' in FIG. 4. The corrugated cardboard sheet 1'' is then passed through two pairs of line marking rolls 21, 22 and 23, 24 of the sheet discharge portion 4 by two pairs of feed rolls 17, 18 and 19, 20 and then through a slitter roll 25 and a receiving roll 26. Thus, a corrugated cardboard sheet 1''' equipped with a ruled line k and slits S is obtained as depicted in FIG. 5.

Figure 6:
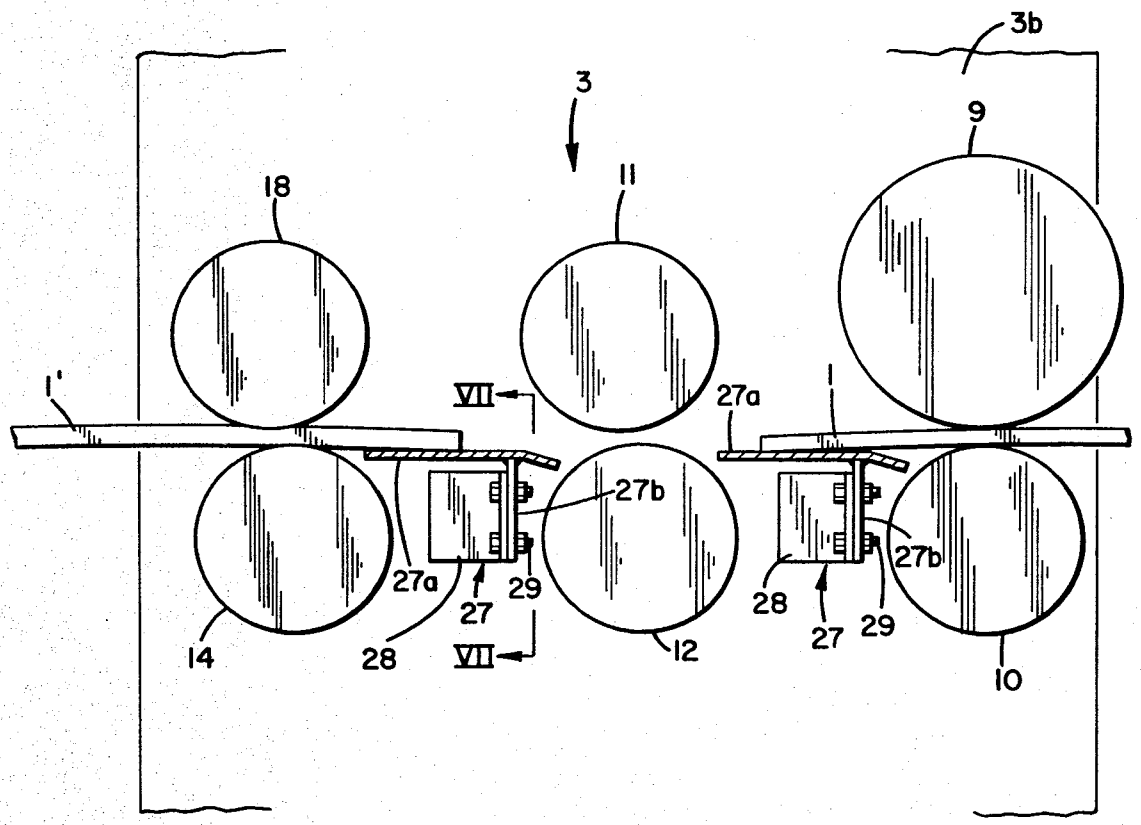
FIG. 6 PRIOR ART
FIG. 6 is an enlarged side elevation view of a printing portion of the machine shown in FIG. 1.
Figure 7:
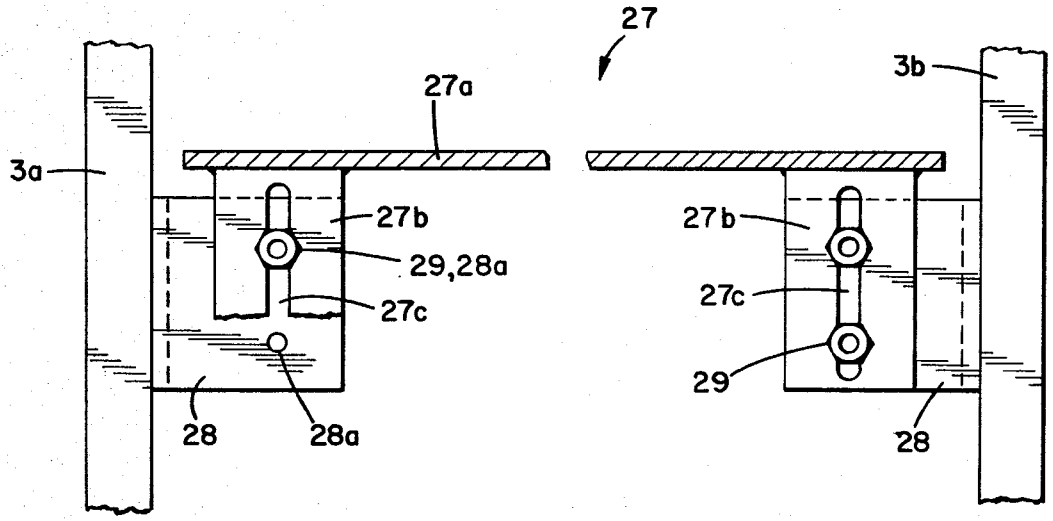
FIG. 7 PRIOR ART
FIG. 7 is an enlarged sectional view taken along the line VII—VII of FIG. 6.

FIGS. 6 and 7 illustrate the construction of the sheet guide 27 disposed in the printing portion 3 shown in FIG. 1. The sheet guide 27 of the printing portion 3' also has the same construction. In FIGS. 6 and 7, each of supports 28, 28 has upper and lower bolt holes **28*a*, 28*a* and one of its ends is fixed to the inner side surface of a corresponding frame unit 3*a*, 3*b*. Each leg 27*b* of a guide plate 27*a* has an elongated hole 27*c* extending in the vertical direction and the guide plate 27*a* is fixed to the support 28*a* by two bolts 29, 29 so that its level may be adjusted. This level adjustment of the guide plate 27*a* is made manually by use of the elongated holes 27*c***.

Figure 8:
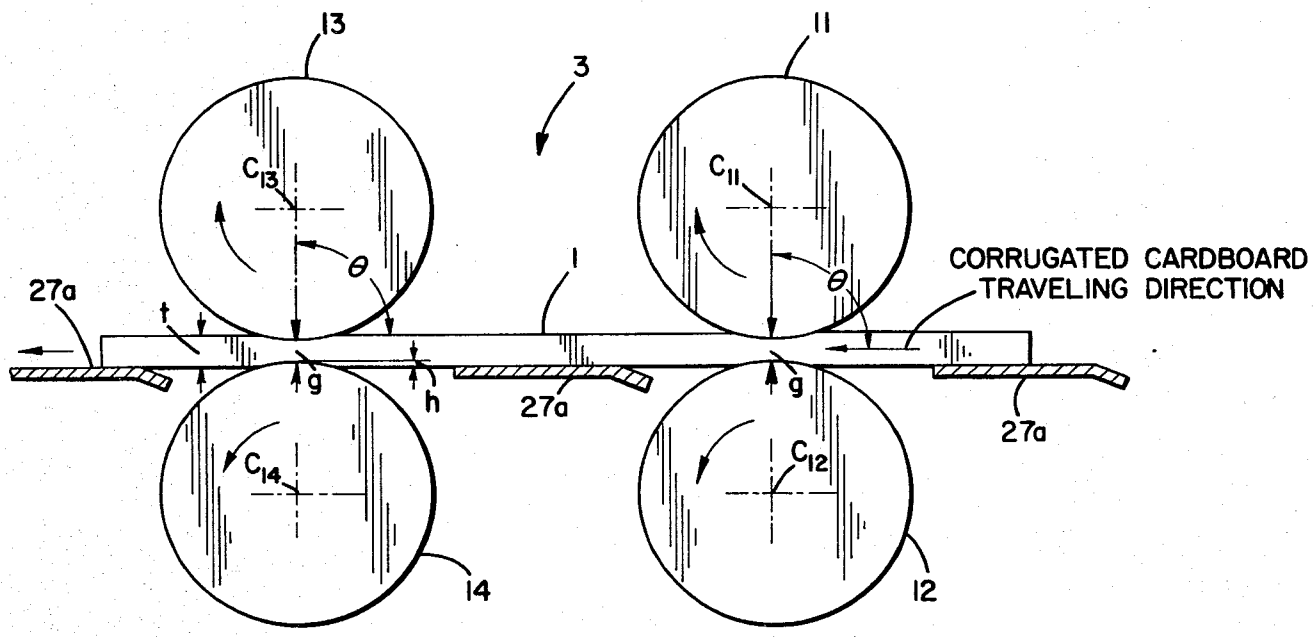
FIG. 8 is a side elevation view showing an ideal arrangement for a corrugated cardboard sheet, feed rolls and sheet guides.

FIG. 8 illustrates an ideal state in which the corrugated cardboard sheet 1 having a thickness t is guided on the upper surface of the guide plate **27*a* by two pairs of feed rolls 11, 12 and 13, 14**, the sheet being moved in the direction indicated by an arrow. The ideal state means one in which:

(1) The corrugated cardboard sheet 1 is free from warp;

(2) The angle of entrance $\theta$ of the corrugated cardboard sheet to the feed rolls 11, 12 or 13, 14 is at right angles with respect to the plane including the axial centers $C_{11}$ and $C_{12}$ of the feed rolls 11 and 12, and the plane including the axial centers $C_{13}$ and $C_{14}$ of the feed rolls 13 and 14; and (3) The level difference h between the upper edges of the lower feed rolls 12, 14 and the upper surface of the guide plate **27*a* satisfies the relation $h=(t-g)/2$, where g is the gap between feed rolls 11, 12 and between feed rolls 13, 14**.

Figure 9:
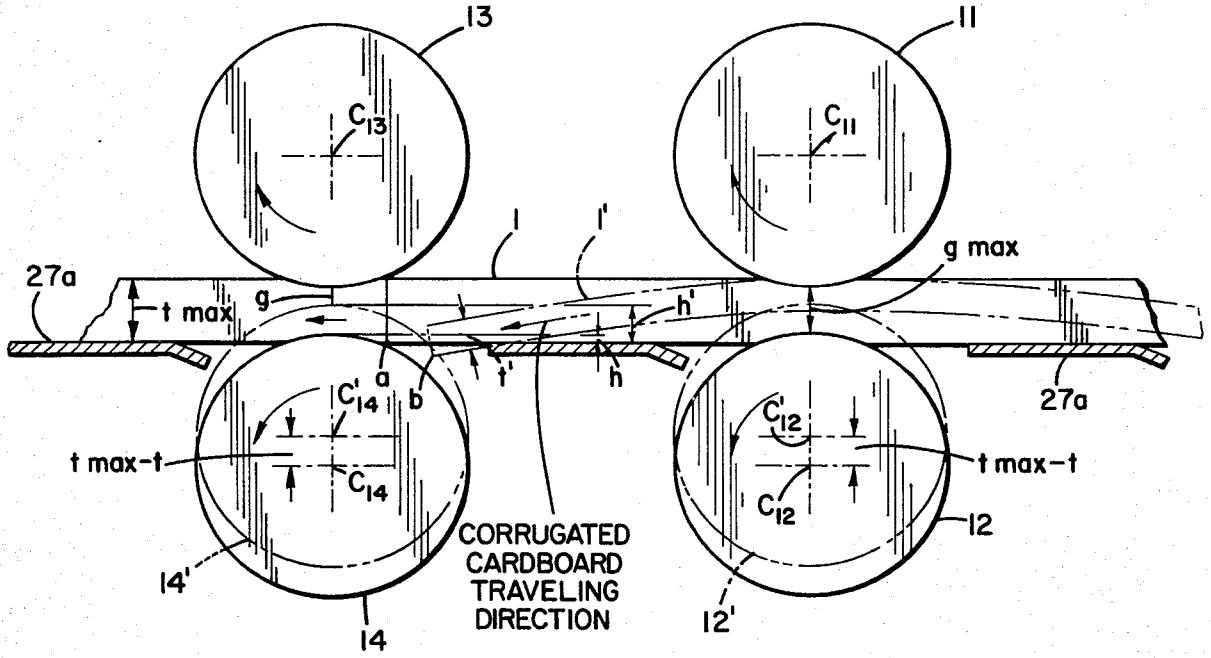
FIG. 9 is a view similar to FIG. 8 but showing such an arrangement in a conventional machine.

FIG. 9 shows the relation between the conventional feed rolls 11, 12 and 13, 14 and the guide plate **27*a* with respect to the corrugated cardboard sheet 1 or 1'. Successive runs of corrugated cardboard sheets processed in the machine may vary in thickness. Assume that the feed rolls 12, 14 represented by solid line in FIG. 9 are adjusted at positions corresponding to the maximum thickness ($t_{max}$) of the corrugated cardboard sheet, and the level of each guide plate 27*a* is set at a position which is a distance h below the upper periphery of the feed rolls 12, 14. It will be now assumed that machining of the corrugated cardboard sheet is finished under such a state and a corrugated cardboard sheet having a smaller thickness t' is then to be sent through the machine. It is necessary in this case to move the feed rolls 12, 14 vertically upward by an amount ($t_{max}-t'$) to the position represented by dotted line and indicated by the numerals 12', 14'. Although it is also necessary to move up the guide plate 27*a* upwardly by the same amount ($t_{max}-t'$), to maintain the difference h between the upper periphery of the feed rolls 12, 14 and level of the guide plate 27*a*. However, this is usually not done because of the time required in conventional machines and the resulting loss of production. In conventional machines, it is necessary to provide work space to make this adjustment, and the printing portions 3, 3' and the discharge portion 4** shown in FIG. 1 must be opened to secure this work space. This requires a substantial amount of time.

However, if the level adjustment of the guide plate **27*a* is not made, its difference in level with respect to the feed rolls 12', 14'** becomes h' which is greater than h.

If a corrugated cardboard sheet having the thickness t' and warp enters under such a condition, the state represented by dotted line in FIG. 9 is reached. Under this state, the tip of the corrugated cardboard sheet 1' impinges against the feed roll 14' at the point b and the angle of entrance of the sheet is not a right angle with respect to the plane $C_{13}$–$C'_{14}$ including the axial centers $C_{13}$ and $C_{14}$ of the feed rolls 13 and 14. Accordingly, the feed speed of the corrugated cardboard sheet 1' does not match with the peripheral speed of the feed roll in its adjusted position 14'.

This phenomenon also takes place when the corrugated cardboard sheet 1' passes the feed rolls 11 and 12', and all the other feed and receiving rolls, resulting in the timing error of the feed of the corrugated cardboard sheet to printing and ruling thereon. Therefore, the resulting products have a low accuracy of finishing.

These deficiencies of prior art apparatus are overcome by the apparatus of this invention. By this invention there is provided a sheet guide apparatus which is compact in construction but can maintain always a predetermined level of accuracy of finishing irrespective of the thickness of the corrugated cardboard sheets to be machined. According to this invention, the position adjustment of the feed rolls or receiving rolls is made in an interlocking arrangement with the position adjustment of the sheet guide plates. It is not necessary to separately adjust the position of the sheet guide plates as in the conventional apparatus. Accordingly, a predetermined level of accuracy of finishing can be maintained without requiring the loss of time in machining the corrugated cardboard sheets and the production efficiency as well as quality of the products is markedly improved.

Figure 10:
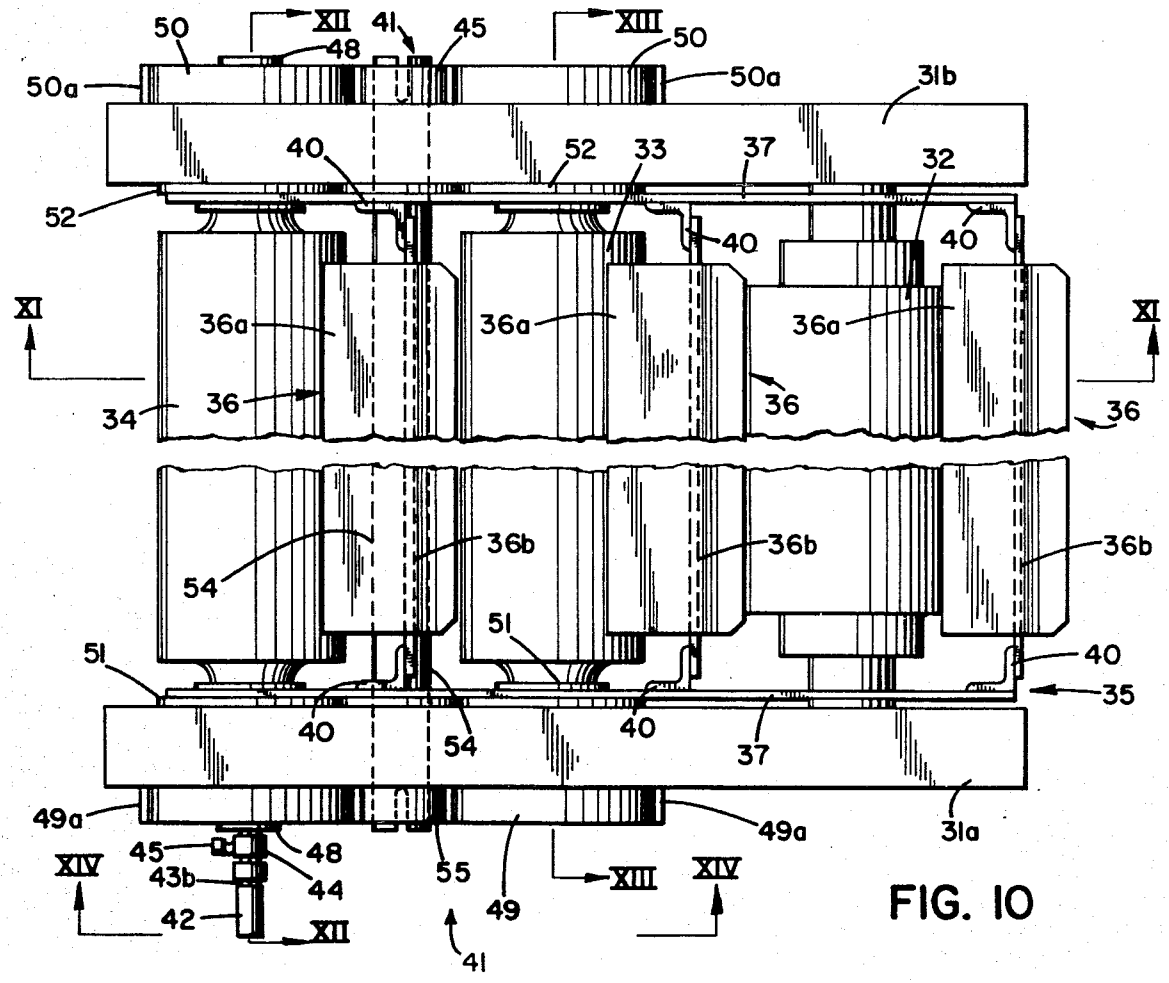
FIG. 10 is a top plan view of apparatus embodying this invention.
Figure 11:
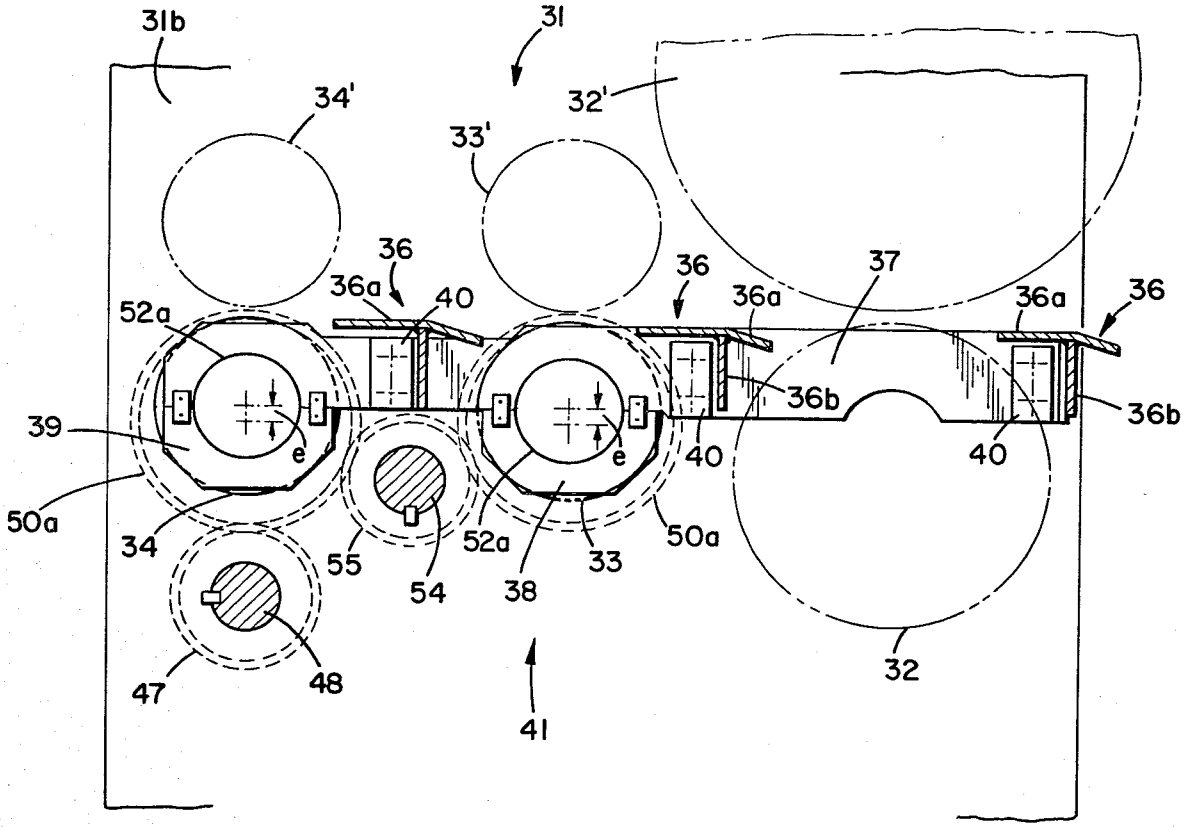
FIG. 11 is a sectional view taken along the line XI—XI of FIG. 10.

The preferred embodiment of the present device will now be described with reference to FIGS. 10 to 14. In FIGS. 10 and 11, the sheet guide apparatus 35 of this invention comprises a plurality of sheet guides 36 and brackets 37, 38 and 39. Each sheet guide 36 in turn comprises a guide plate 36*a* and legs 36*b* fixed to the guide plate 36*a* in the T form.

The brackets 37, 37 extend longitudinally over bearing supports 51 and 52, and beyond the shaft of a receiving roll 32. The brackets 38, 39 are disposed at the shaft portions of feed rolls 33, 34 so as to encompass the lower semicircular portion of the bearing supports 51 and 52. Brackets 38, 39 are fixed to the lower edge of the bracket 37, as shown in FIG. 11. The legs 36*b* are fixed to a bracket 40 which is fixed to the inner side surface of the brcket 37 and the sheet guide 36 keeps the upper surface of the guide plate 36*a* horizontal and is interconnected to the bracket 37 at the position shown in the drawing.

Figure 12:
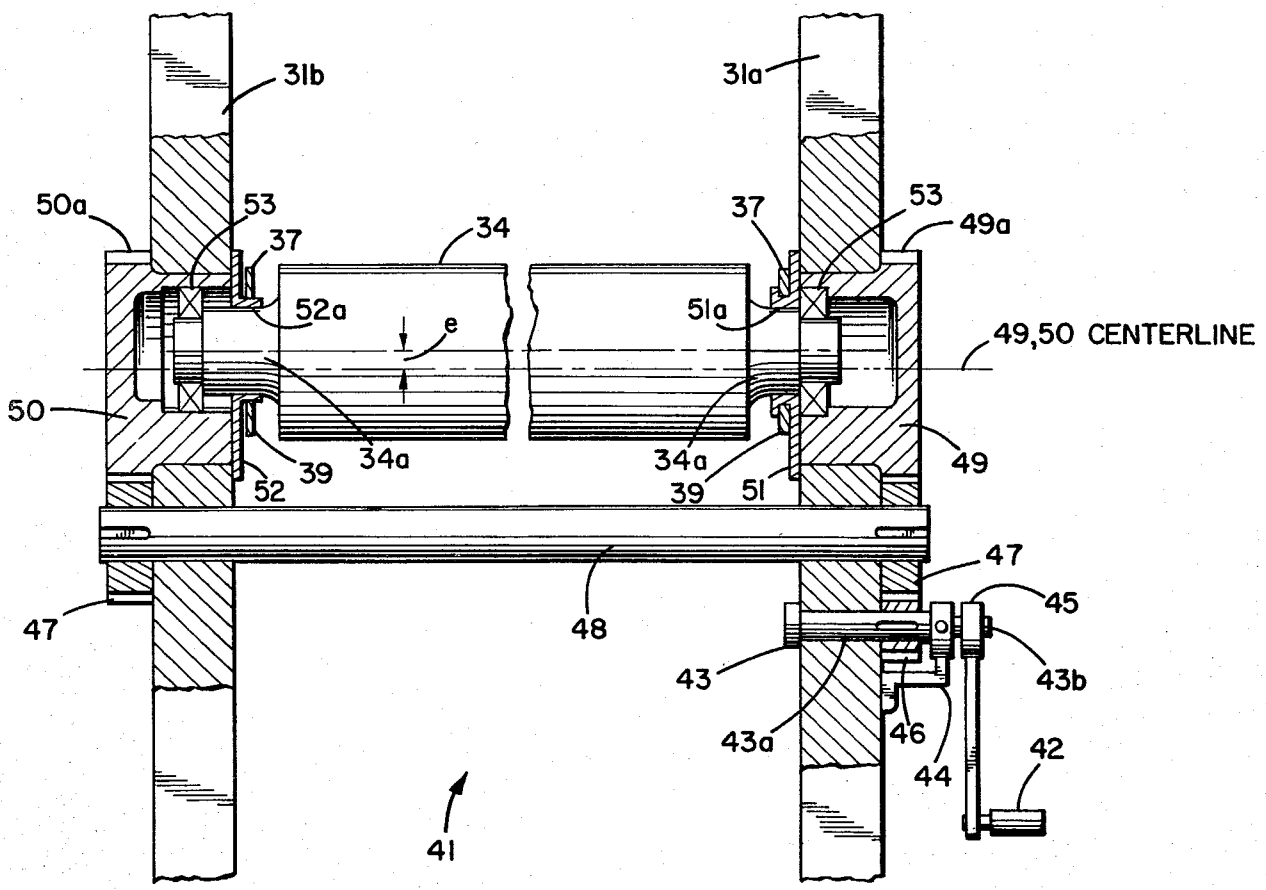
FIG. 12 is a sectional view taken along the line XII—XII of FIG. 10.

Referring now to FIG. 12, eccentric bearing boxes 49, 50 are rotatably mounted in openings in frames 31*a*, 31*b*, respectively. Each eccentric bearing box has a center which is displaced eccentrically by a distance e from the center of the feed roll 34. The bearing boxes rotatably support both shaft end portions of the feed roll 34 by means of bearings 53 that are positioned within the hollow interior of the bearing boxes. The portions of the bearing boxes 49, 50 projecting outside the frames 31*a*, 31*b* have gears 49*a*, 50*a*, respectively. The bearing supports 51, 52 are fixed to the inner surfaces of the eccentric bearing boxes 49, 50, respectively in such a manner that their inner diameter surfaces keep a slight gap between the outer circumferential surfaces of the shafts 34*a*, 34*a* of the feed roll 34.

A shaft 48 is rotatably supported by the frames 31*a* and 31*b* below the feed roll 34. An idle gear 47 is keyed to each end of the shaft 48, and engaged with a corresponding one of the gears 49*a* and 50*a*.

A shaft 43 is rotatably supported in an opening in the frame 31*a*.

Figure 14:
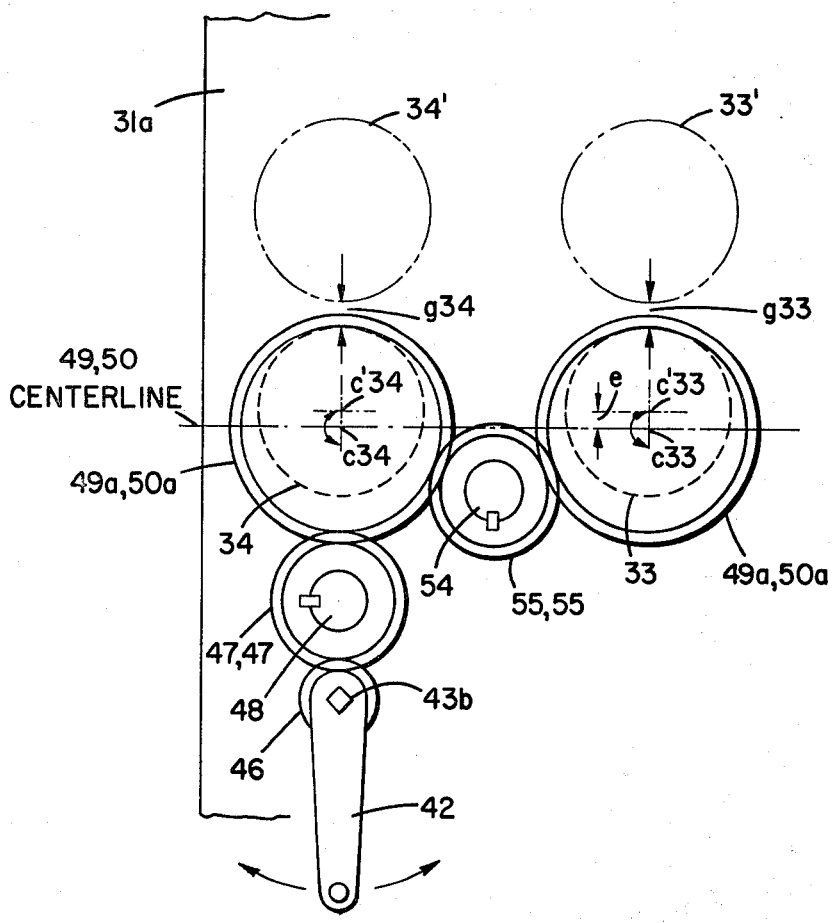
FIG. 14 is a side elevation view taken in the direction of the line XIV—XIV of FIG. 10.

A pinion 46 is keyed at one of the ends of a cylindrical portion 43*a* of the shaft 43, and engages one of the idle gears 47. A bracket 44 equipped with a set screw 45 is fitted also to this end of the shaft 43. The lower end of the bracket 44 is fixed to the frame 31*a*. The shaft 43 includes a square portion 43*b* and a handle 42, having a corresponding square opening therein is mounted on the portion 43*a*, as shown in FIG. 14. The bearing supports 51, 52 include transversely projecting portions 51*a*, 52*a*, respectively, about which the brackets 37, 39 are rotatably fitted.

Figure 13:
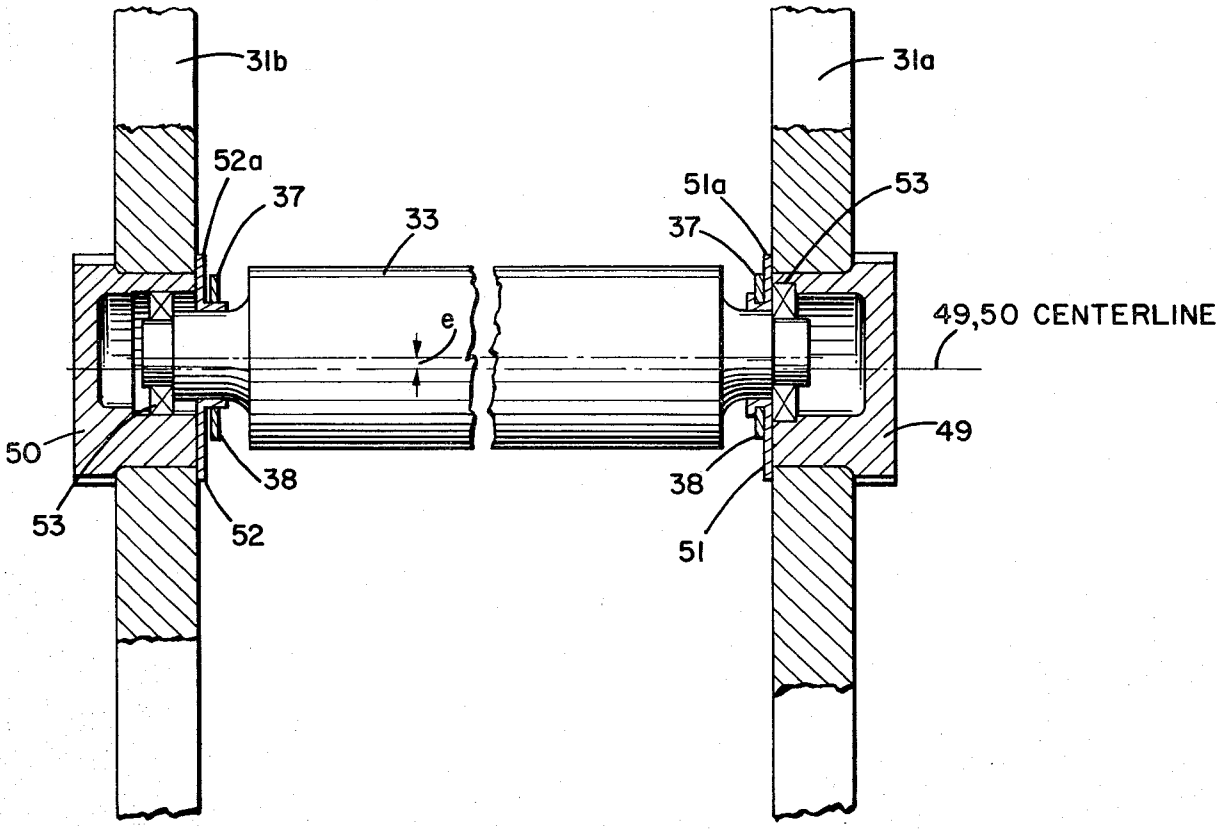
FIG. 13 is a sectional view taken along the line XIII—XIII of FIG. 10.

Similarly, as shown in FIG. 13, eccentric bearing boxes 49, 50, each having a center which is displaced eccentrically by the distance e from the center of the feed roll 33, are rotatably supported by the frames 31*a*, 31*b* and support rotatably both shaft ends of the feed roll 33 by their bearings 53. The brackets 37, 38 rotatably engage with the bearing supports 51, 52 at their transversely projecting portions 51*a*, 52*a*.

Where two sets of feed rolls 33, 33' and 34, 34' are employed, idle gears 55 are provided, as shown in FIGS. 10, 11 and 14. The idle gears 55 are keyed to both ends of a shaft 54 which is rotatably supported by the frames 31*a*, 31*b*. One of the idle gears 55 is engaged between both gears 49*a*, 49*a* on the eccentric bearing boxes 49, 49, and the other idle gear 55 is engaged between both gears 50*a*, 50*a* on the eccentric bearing boxes 50, 50, as shown in FIGS. 11 and 14.

This embodiment of the invention described operates in the following manner. The handle 42 can be turned in one direction to increase the gap $g_{33}$ between the feed rolls 33 and 33' and the gap $g_{34}$ between the feed rolls 34 and 34' (see FIG. 14), and in the opposite direction to decrease those gaps. For example, the gaps $g_{33}$ and $g_{34}$ can be decreased if the handle 42 is rotated clockwise in FIG. 14. The rotation of the handle 42 causes rotation of the pinion 46, the idle gears 47, 47 and the shaft 48, and thereby of the gears 49*a*, 50*a*. The centers $c_{34}$ and $c_{33}$ of the feed rolls 34 and 33 move on a semicircular orbit having the eccentricity e between the centers $c'_{34}$, $c'_{33}$ of the feed rolls 34, 33 and the centers of the eccentric bearing boxes 49, 50 as the radius. Thus, the level of the feed rolls 33 and 34 can be adjusted in the interlocking arrangement with each other within the range corresponding to 2*e*, that is, in the distance from $c_{34}$, $c_{33}$ to $c'_{34}$, $c'_{33}$.

When the adjusting operation described above is conducted, the brackets 37, 39, 38 move up and down following the rotation of the eccentric bearing boxes 49, 50 via the bearing supports 51, 52, as shown in FIGS. 12 and 13. The sheet guide 36, which is supported on the brackets also moves up and down together with the brackets 37, 39, 38 by the same amount as the centers of the feed rolls 33 and 34 are moved and simultaneously therewith. Therefore, the level difference h between the upper edges of the feed rolls 33, 34 and the upper surface of each guide plate 36*a* (see FIG. 8) is maintained at a constant value.

In this embodiment, if the thickness of the corrugated cardboard sheet supplied through the gaps g (see FIG. 1) between the group of upper and lower rolls changes, the positions of the feed rolls 33, 34 can be adjusted to suitable positions in the vertical direction by simply moving the handle 42 clockwise or counterclockwise, as described above. At the same time, the position of the upper surface of each guide plate is adjusted so as to follow the displacement in the vertical direction resulting from the adjustment of the feed rolls 33, 34. Accordingly, this arrangement altogether eliminates the problem with the prior art apparatus and makes it possible to efficiently produce corrugated cardboard sheet having stabilized accuracy of finishing. Moreover, the adjusting means, namely the handle 42, is easily accessible, the adjustment can be easily and quickly made, and the adjustment of the guide plates does not require opening portions of the apparatus to secure work space.

Figure 15:
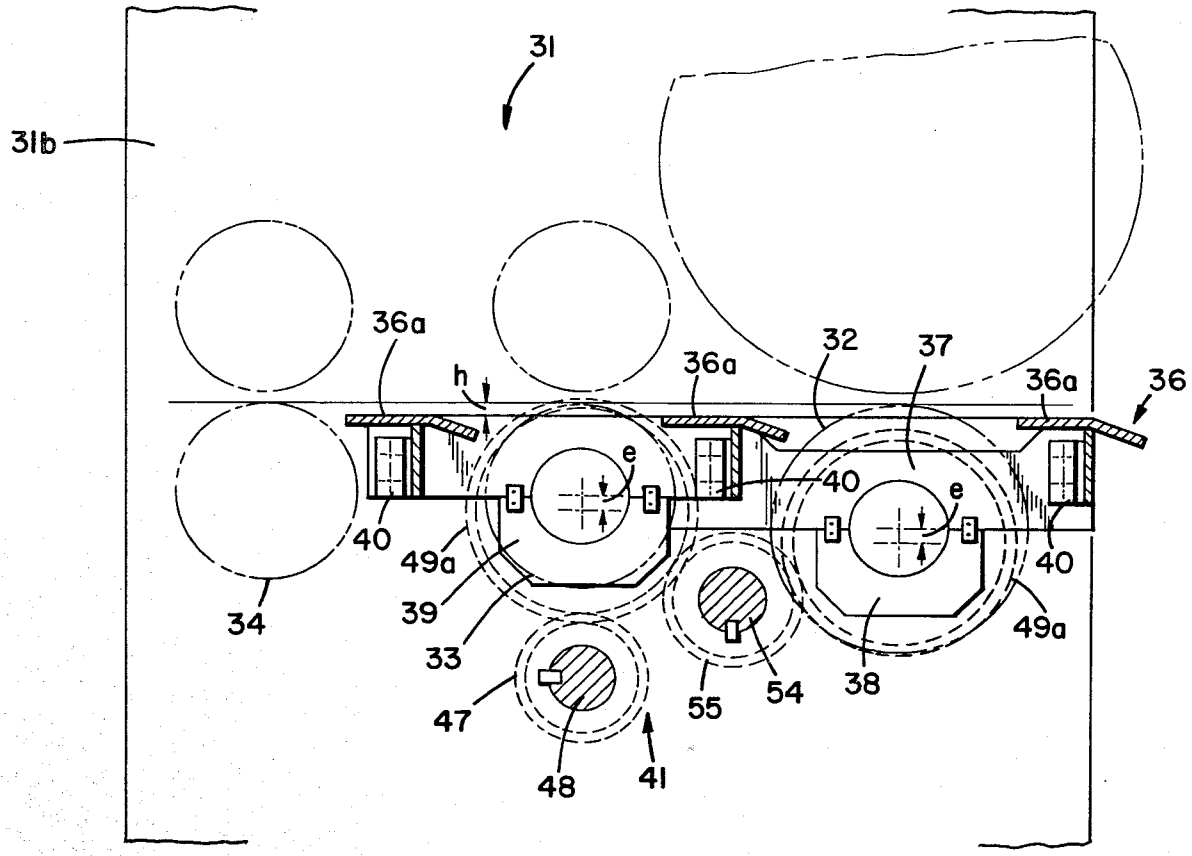
FIG. 15 is a side elevation view, partly in section of an apparatus showing another embodiment of this invention.

In the embodiment described above, the positions of the feed rolls 33, 34 and the guide plate 36*a* are adjusted, but it is also possible to support the receiving rolls 32 by the frames 31*a*, 31*b* using the same construction as the feed rolls 33, 34 and to adjust their position integrally with the feed rolls. It is also possible to independently adjust the position of the receiving rolls 32 in response to the adjustment of the feed rolls. Furthermore, in the embodiment described above, the positions of the receiving rolls 32 and feed rolls 33, 34 can be adjusted in the vertical direction in integral arrangement with each guide plate 36*a*. However, the following construction may also be employed. As shown in FIG. 15, the guide plates 36*a* are formed integrally with one another by use of the bracket 37 which is the same as one used in the embodiment described above, and the receiving roll 32 is rotatably supported by the eccentric bearing boxes 49, 50. The idle gears 47, 55 are arranged as shown in FIG. 15 and the shaft 48 is operated by the handle 42 in the same manner as shown in FIGS. 12 and 14 so as to adjust the positions of the receiving roll 32, feed rolls 33 and guide plates 36*a* in the vertical direction.

Although the sheet guide 36 is engaged with the eccentric bearing boxes 49, 50 in the embodiment described above, it is also possible to use such a construction in which the eccentric bearing boxes 49, 50 are fitted to the receiving roll 32' and to the feed roll 34' and the bracket 37 is suspended from these eccentric bearing boxes so that the positions of each guide plate 36*a*, receiving roll 32' and feed rolls 33', 34' can be integrally adjusted in the vertical direction.

It is claimed:

1. Apparatus for guiding corrugated cardboard sheet in a corrugated cardboard sheet box-making machine comprising:

(a) a pair of feed rolls for moving sheets through the machine;

(b) eccentric bearing boxes for supporting the ends of one of said feed rolls;

(c) means for rotating said bearing boxes to adjust the position of said one of said feed rolls for varying the gap between said feed rolls;

(d) sheet guide means for guiding said sheet; and (e) means responsive to movement of said bearing boxes for adjusting the position of said guide means to maintain a constant difference in level between the periphery of said adjustable feed roll at said gap and the level of said guide means.

2. The apparatus as recited in claim 1 wherein said means for rotating said bearing boxes includes a first gear fixed to each bearing box and means engaging said first gear for rotating said gear.

3. The apparatus as recited in claim 2 wherein said means for rotating said first gear comprises:

(a) a second gear engaging said first gear;

(b) a pinion engaging said second gear; and (c) a handle for moving said pinion to effect rotation thereof.

4. The apparatus as recited in claim 1 including:

(a) spaced frames for supporting the ends of said feed rolls;

(b) said bearing boxes being mounted in said frames, each bearing box having a first gear fixed thereto and accessible from the exterior of said frames; and (c) said means for rotating said bearing boxes comprises means engaging said first gear for effecting rotatio thereof.

5. The apparatus as recited in claim 4 and further including:

(a) a shaft mounted on said frames;

(b) second gears mounted on said shaft and engaging said first gears;

(c) a pinion mounted on one of said frames and engaging one of said second gears; and (d) a handle for moving said pinion to effect rotation thereof for adjusting the position of said one of said feed rolls and of said guide means.

6. The apparatus as recited in claim 2 and including:

(a) a second pair of feed rolls;

(b) second eccentric bearing boxes for one of said second pair of feed rolls, said second eccentric bearing boxes having a first gear mounted thereon;

(c) an idle gear engaging said first gear of said first eccentric bearing boxes and said first gear of said second eccentric bearing boxes to effect simultaneous adjustment of the gap between said first pair of feed rolls and the gap between said second pair of feed rolls.

7. The apparatus as recited in claim 1 wherein said means for adjusting the position of said one of said feed rolls and of said guide means includes:

(a) a bearing support mounted on each of said eccentric bearing boxes and movable therewith;

(b) brackets engaging said bearing supports, said guide means being supported by said brackets;

(c) whereby movement of said bearing supports by rotation of said eccentric bearing boxes effects corresponding movement of said brackets to adjust the position of said guide means simultaneously with adjustment of the position of said one of said feed rolls and in substantially the same amount.

* * * * *